US007176392B2

(12) United States Patent
Mimata et al.

(10) Patent No.: US 7,176,392 B2
(45) Date of Patent: Feb. 13, 2007

(54) MULTI-CONTACT INPUT DEVICE

(75) Inventors: Yoshihisa Mimata, deceased, late of Higashiosaka (JP); by Satoko Mimata, legal representative, Higashiosaka (JP); Takuhiko Saomoto, Toyonaka (JP)

(73) Assignee: Hosiden Corporation, Yao (JP)

( * ) Notice: Subject to any disclaimer, the term of this patent is extended or adjusted under 35 U.S.C. 154(b) by 0 days.

(21) Appl. No.: 11/198,907

(22) Filed: Aug. 8, 2005

(65) Prior Publication Data

US 2006/0060455 A1 Mar. 23, 2006

(30) Foreign Application Priority Data

Aug. 9, 2004 (JP) ..... 2004-232795
May 10, 2005 (JP) ..... 2005-137871

(51) Int. Cl.
*H01H 9/26* (2006.01)

(52) U.S. Cl. ..... 200/5 R; 200/5 A

(58) Field of Classification Search ..... 200/4, 200/18, 5 A, 5 E, 6 A, 520, 406, 1 B
See application file for complete search history.

(56) References Cited

U.S. PATENT DOCUMENTS 4,156,802 A 5/1979 Gilano et al. ..... 200/5 A
4,280,027 A * 7/1981 Comerford et al. ..... 200/6 A
4,315,113 A * 2/1982 Fisher et al. ..... 200/5 R
5,499,041 A 3/1996 Brandenburg et al. ..... 345/174
5,691,517 A * 11/1997 Yamamoto et al. ..... 200/6 A
6,080,941 A 6/2000 Yokobori ..... 200/6 A
6,189,401 B1 * 2/2001 Atwell et al. ..... 74/471 XY
6,262,381 B1 * 7/2001 Kikuchi et al. ..... 200/6 A
6,348,664 B2 * 2/2002 Kozuma ..... 200/6 A
6,423,911 B2 * 7/2002 Yoshida et al. ..... 200/6 A
6,525,279 B2 * 2/2003 Sato ..... 200/6 A
6,593,909 B1 * 7/2003 Chou ..... 345/157
6,720,504 B2 * 4/2004 Nishimoto et al. ..... 200/4

(Continued)

FOREIGN PATENT DOCUMENTS

DE 44 43 726 A1 6/1995

(Continued)

OTHER PUBLICATIONS

Extended European Search Report mailed Aug. 3, 2006 (4 pages).

*Primary Examiner*—Michael Friedhofer
*Assistant Examiner*—Lisa Klaus
(74) *Attorney, Agent, or Firm*—Armstrong, Kratz, Quintos, Hanson & Brooks, LLP

(57) ABSTRACT

In order to protect a central switch of a multi-contact input device to input various kinds of signals by a pressing operation of an operating member to operate the central switch, an inclining operation of the operating member to operates a plurality of peripheral switches provided in the periphery of the central switch. A push rod projects from a body of an operating member toward a pressing side, and the push rod is movable in an axial direction with respect to the body. The push rod is forced toward the projection side by a spring incorporated in the body with the push rod. The force is set such that it is greater than a force required to operate a central switch and that the central switch is not damaged.

12 Claims, 16 Drawing Sheets

U.S. PATENT DOCUMENTS 6,974,920 B2 * 12/2005 Yu ..... 200/6 A
6,998,553 B2 * 2/2006 Hisamune et al. ..... 200/336

FOREIGN PATENT DOCUMENTS

EP 1 422 733 5/2004
JP 01-302621 12/1989
JP 07-307124 11/1995
JP 8-115641 5/1996
JP 10-154445 6/1998
JP 2001-229786 8/2001

* cited by examiner (a)

(b)

(a)

(b)

(a)

At the time of center push (b)

At the time of center dead weight (a)

At the time of ON (b)

At the time of Over stroke (a)

(b)

(a)

State of center on (b)

State of over stroke (a)

State of On in eight directions (b)

State of over stroke in eight directions

MULTI-CONTACT INPUT DEVICE

BACKGROUND OF THE INVENTION

1. Field of the Invention

The present invention relates to a multi-contact input device in which various kinds of signals are input by operating a central switch by a pressing operation with an operating member, and operating a plurality of peripheral switches provided around the central switch by an inclining operation with the operating member.

2. Description of the Related Art

As shown in Japanese Unexamined Patent Publication No. 8-115641 and Japanese Unexamined Patent Publication No. 10-154445, an input device used as an input device in a VTR, a navigation system and the like is constituted such that a central switch is provided on a bottom plate of a case, a plurality of peripheral switches are provided so as to surround it, the central switch is operated by a pressing operation of the operating member and the peripheral switch positioned in a direction corresponding to an operation direction is operated by an inclining operation of the operating member.

A description will be made of the multi-contact input device disclosed in Japanese Unexamined Patent Publication No. 8-115641 and Japanese Unexamined Patent Publication No. 10-154445 in detail. The input device comprises the following three components basically. The first component is the case in which the central switch is provided on the bottom plate and the plurality of peripheral switches are provided around it. Second component is a drive unit which is provided so that it can be inclined to the periphery in the case to operate the plurality of peripheral switches. Third component is the operating member which penetrates the drive unit in an axis direction so that it can be moved, and which is elastically retained in a neutral position and inclines the drive unit by an inclining operation against its retention force.

Here, the drive unit is housed in a cup-shaped retainer member which is forced upward (opposite direction to the pressing direction) by a center return spring and the drive unit is elastically held in the neutral position by force of the center return spring. A key top in which the peripheral switches are operated is formed on a lower surface of the drive unit.

According to the conventional multi-contact input device, the peripheral switch is operated by forcibly inclining the operating member elastically retained in the neutral position against the retaining force to incline the drive unit and press a diaphragm-shaped movable point of the peripheral switch. Meanwhile, the central switch is operated by directly pressing a diaphragm-shaped movable point (snap plate) of the central switch itself by pressing operation of the operating member. That is, the central switch serves also as a retention spring which forces the operating member upward (the direction opposite to the pressing direction) to elastically retain it in an initial position.

In this constitution, according to the conventional multi-contact input device, when the operating member receives a strong pressing force in the axial direction from the outside because of a droppage and the like, excessive force is applied to the snap plate of the central switch, so that the snap plate is deformed and an operation defect is likely to be generated, which is an essential problem. Similarly, when the operating member receives a strong force in the inclining direction, excessive force is applied to the peripheral switches, so that there is a problem in which an operation defect is likely to be generated.

In addition, if an operation angle is large when the operating member is operated in an inclined position, a sense of operation is better in this kind of input device. However, because the input device is miniaturized, an increase in the operation angle of the operating member is limited, so that a sense of operation becomes poor, which is a problem also.

In view of the problem regarding a sense of operation, according to the multi-contact input device disclosed in the patent document 2, an annular elastic body is intervened between the drive unit and the cup-shaped retainer member holding this, and the drive unit is relatively inclined with respect to the retainer member, so that an over stroke is provided and thus the operation angle is increased. However, in this method, it is necessary to provide the elastic body between the drive unit and the retainer member additionally, so that a secondary problem in which the number of parts is increased is generated.

SUMMARY OF THE INVENTION

The present invention was made in view of the above problems and it is an object of the present invention to provide a multi-contact input device which can effectively protect a central switch even when an excessive load in an axial direction is applied to an operating member.

It is another object of the present invention to provide a multi-contact input device which can effectively protect a peripheral switch even when an excessive load in an axial direction is applied to an operating member.

It is still another object of the present invention to provide a multi-contact input device which can increase an operation angle of an operating member without increasing the number of parts so that a sense of operation is preferable and economical efficiency is preferable.

In order to attain the above objects, a multi-contact input device according to the present invention comprises a cover, a body in which the cover is mounted, a central switch is provided on a bottom plate, and a plurality of peripheral switches are provided around it, a drive unit provided so that it is inclinable to the periphery in a space between the cover and the body to operate the plurality of peripheral switches, and an operating member which penetrates the drive unit in an axial direction, elastically held in a neutral direction, inclines the drive unit when inclined to the periphery against its holding force, or operates a central switch by a pressing operation in the axial direction, in which the operating member has a push rod which projects from a main body of the operating member to the pressing side and is movable in the axial direction with respect to the operating member to operate the central switch, and a spring which is incorporated in the main body of the operating member with the push rod and forces the push rod with force which is stronger than force required to operate the central switch and does not damage the central switch.

The multi-contact input device has a composite structure in which the operating member comprises its main body, the slidable push rod projecting from the main body to the pressing direction, and the spring forcing the push rod to the projection side. According to this composite structure, when an excessive load in the axial direction is applied to the operating member, because the push rod retreats to the direction opposite to the pressing direction against the force of the spring and its load is absorbed, the central switch is protected. In addition, an over stroke in the pressing direction can be provided because the push rod retreats.

Regarding the operation angle of the operating member, the operating member and the drive unit are arranged so that the operating member is inclinable to the periphery with respect to the drive unit, and an elastic body which elastically holds the operating member in a neutral position with respect to the drive unit is provided. Thus, because the operating member is inclinable to a greater degree than the inclination angle of the drive unit, the over stroke in the inclining direction can be provided.

At this time, the elastic body is arranged so that the operating member is not inclined with respect to the drive unit when the operating member is operated to incline the drive unit, and the operating member is inclined with respect to the drive unit when the operating member is operated with a force beyond a force which inclines the drive unit, so that the peripheral switch can be protected.

In addition, a spring for protecting the switch, incorporated in the operating member as the elastic body can be used, so that the over stroke can be provided with a simple arrangement without using the elastic body for the over stroke in the inclining direction.

The drive unit can be separated from the operating member or it can be integrated with the operating member. When the drive unit is integrated with the main body of the operating member, because the drive unit can be directly inclined by the inclining operation of the operating member and the drive unit can be inclined centering around a pressed point even after the drive unit presses the peripheral switch, the over stroke of the operating member in the inclining direction can be provided. In addition, the peripheral switch can be protected.

Meanwhile, if the drive unit is integrated with the push rod of the operating member, when excessive inclining force is applied to the operating member, the spring for protecting the switch incorporated in the operating member shrinks. Thus, the excessive part of the inclining force is absorbed and the peripheral switch can be protected and the over stroke of the operating member in the inclining direction can be provided.

Regarding the case, it is preferable that a stopper is provided in the bottom plate part to prevent movement of the drive unit or the operating member which is pressed in, toward the pressing side. Thus, the central switch or the peripheral switch can be further surely protected.

The multi-contact input device comprises a case in which a central switch is provided on a bottom plate and a plurality of peripheral switches are provided around it, a drive unit provided so as to be inclinable to the periphery in the case to operate the plurality of peripheral switches and held in a neutral position by an elastic body, and an operating member which penetrates the drive unit in the axial direction so as to be movable and inclines the drive unit by its inclining operation and operates the central switch by its pressing operation in the axial direction, in which in order to operate the central switch, the push rod is arrange so as to project from a main body of the operating member to the pressing side and it can be moved with respect to the main body of the operating member in the axis direction, and the push rod is forced to the projection side by a spring incorporated in the main body with the push rod with a force which is greater than a force required to operate the central switch and which does not damage the central switch.

The multi-contact input device has a composite structure in which the operating member comprises its main body, the slide push rod projecting from the main body to the pressing direction, and the spring forcing the push rod to the projection side. According to this composite structure, when an excessive load in the axis direction is applied to the operating member, because the push rod retreats to the direction opposite to the pressing direction against the force of the spring and its load is absorbed, the central switch is protected.

Regarding the operation angle of the operating member, the operating member and the drive unit are arranged such that the operating member is inclinable to the periphery with respect to the drive unit, the operating member is elastically held in a neutral position with respect to the drive unit using force by the spring, and the elastic body is arranged so that the operating member is not inclined with respect to the drive unit when the operating member is operated to incline the drive unit, and the operating member is inclined with respect to the drive unit when the operating member is operated with a force greater than a force which inclines the drive unit.

In this arrangement, the over stroke can be provided, using the spring for protecting the switch, which is incorporated in the operating member. That is, the over stoke can be provided without using the elastic body for the over stroke.

In order to surely protect the central switch, as an elastic body which forces the operating member in a direction opposite the pressing direction, addition to the snap plate of the central switch, the elastic body which holds the drive unit in the neutral position is used. More specifically, the operating member is incorporated in the drive unit so that the main body is forced from the drive unit to a direction opposite the pressing direction and the push rod is forced from the drive unit to the pressing direction by the spring.

In this case, it is preferable that a stopper for preventing the drive unit from being lowered is provided in the bottom plate of the case. Thus, the central switch can be more surely protected.

Because the multi-contact input device has a composite structure in which the operating member comprises its main body, the slidable push rod projecting from the main body to the pressing direction, and the spring forcing the push rod to the projection side, when an excessive load in the axis direction is applied to the operating member, the push rod retreats to the direction opposite to the pressing direction against the force of the spring, so that the central switch is protected while the over stroke in the pressing direction can be provided.

When the drive unit is separated from the operating member and the operating member can be inclined to the periphery with respect to the drive unit, or the drive unit is integrated with the operating member, even in the case the operating member is inclined to the periphery, the peripheral switch can be protected while the over stroke in the inclining direction can be provided, so that the number of parts can be prevented from being increased by using the spring in this protection operation.

Because the multi-contact input device has a composite structure in which the operating member comprises its main body, the slide push rod projecting from the main body to the pressing direction, and the spring forcing the push rod to the projection side, when an excessive load in the axis direction is applied to the operating member, the push rod retreats in the direction opposite the pressing direction against the force of the spring and its load is absorbed, so that the central switch is protected.

Regarding the operation angle of the operating member, when the operating member and the drive unit are arranged such that the operating member is inclinable to the periphery with respect to the drive unit and the operating member is elastically retained in the neutral position with respect to the drive unit using the spring incorporated in the operating member, the operation angle of the operating member can be increased and a sense of operation can be improved without increasing the number of parts.

DETAILED DESCRIPTION OF THE PREFERRED EMBODIMENTS

An embodiment of the present invention will be described with reference to the drawings hereinafter.

Figure 1:
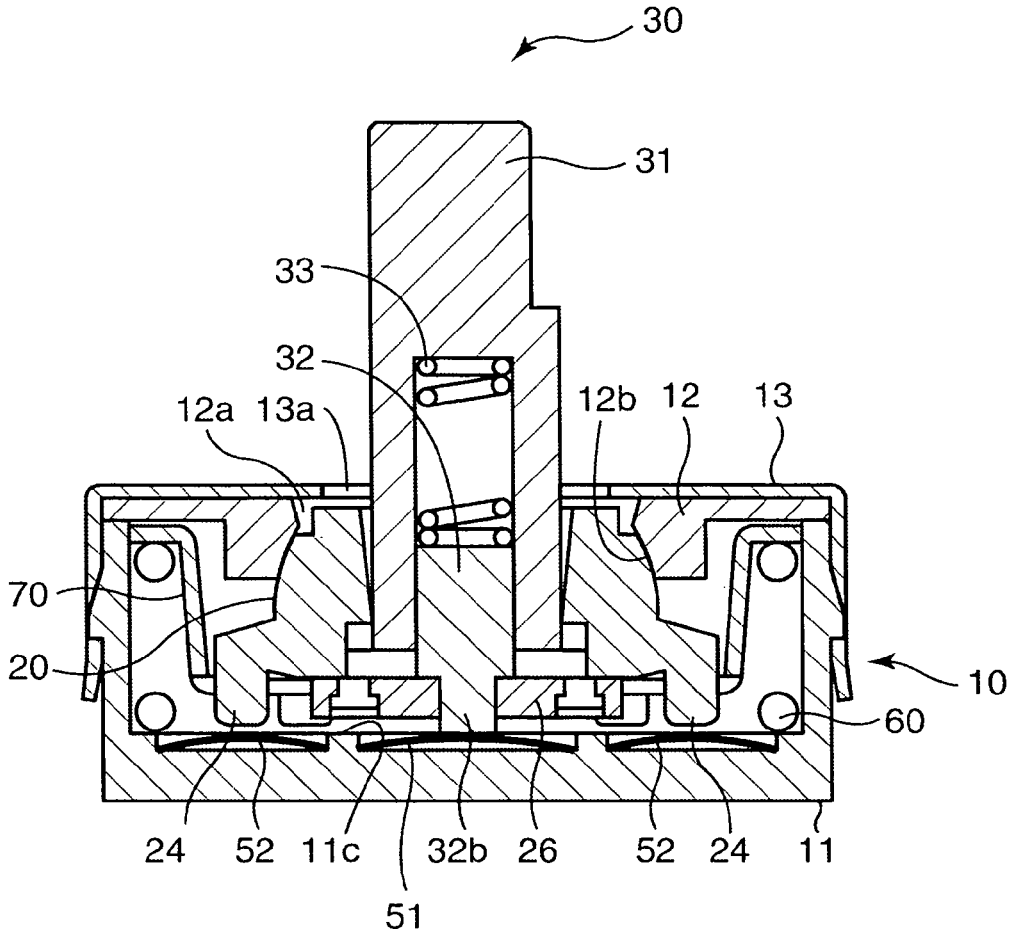
FIG. 1 is a vertical sectional view showing a multi-contact input device according to one embodiment of the present invention.
Figure 2:
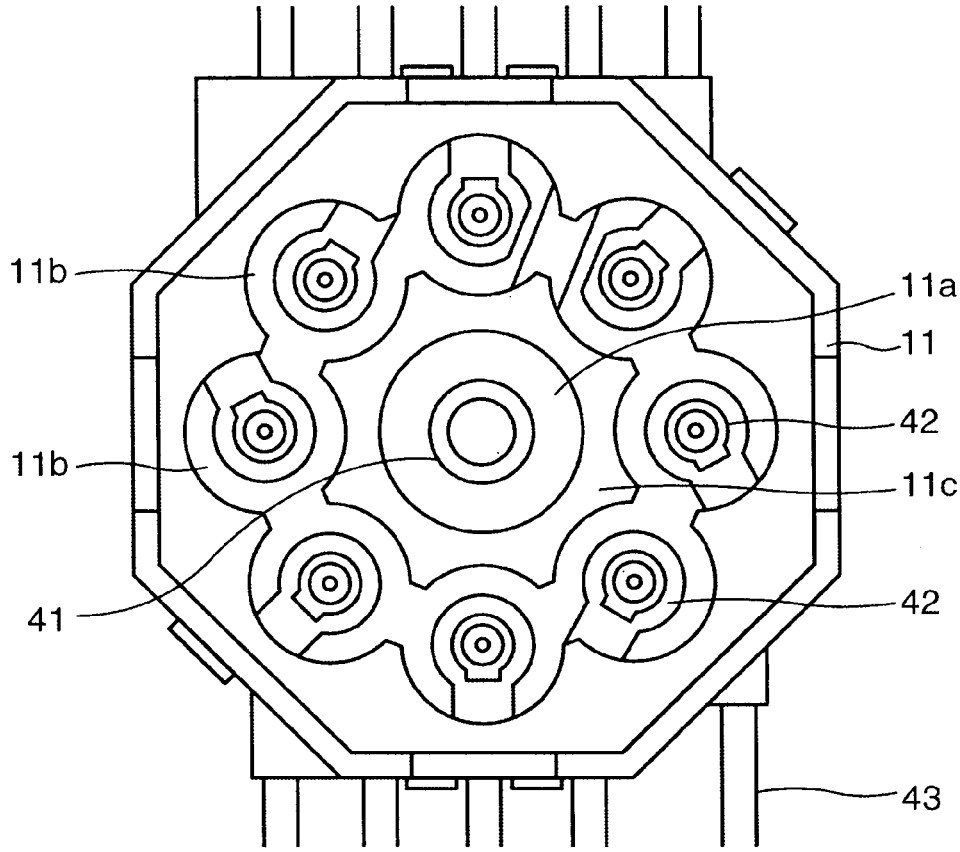
FIGS. 2 are views showing two sides of a body used in the multi-contact input device, in which (a) is a plan view and (b) is a vertical sectional view.
Figure 2:
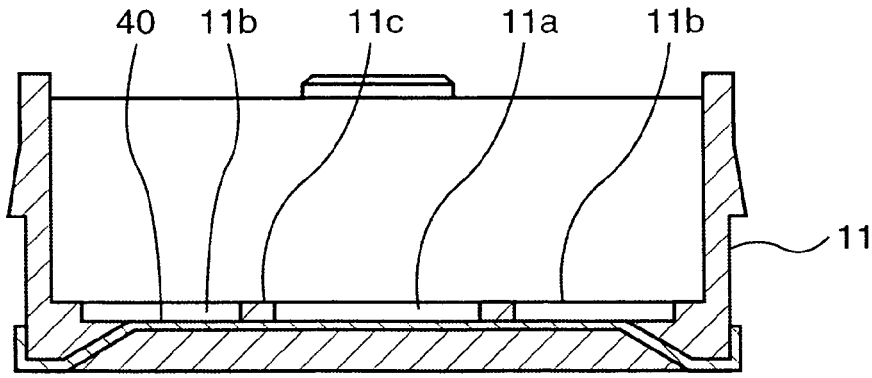
Figure 3:
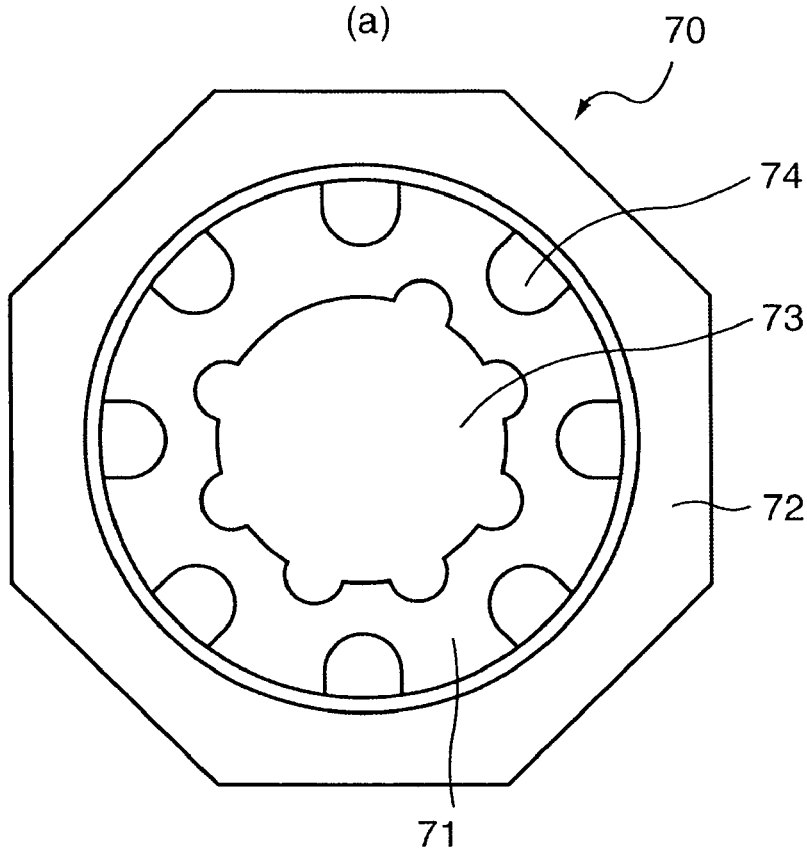
FIGS. 3 are views showing two sides of a component of a drive unit used in the multi-contact input device, in which (a) is a plan view showing an outer member and (b) is a vertical sectional view showing the outer member.
Figure 3:
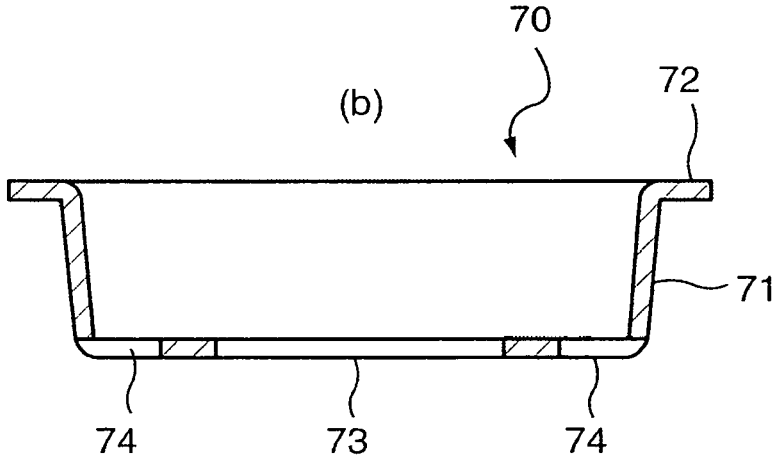
Figure 4:
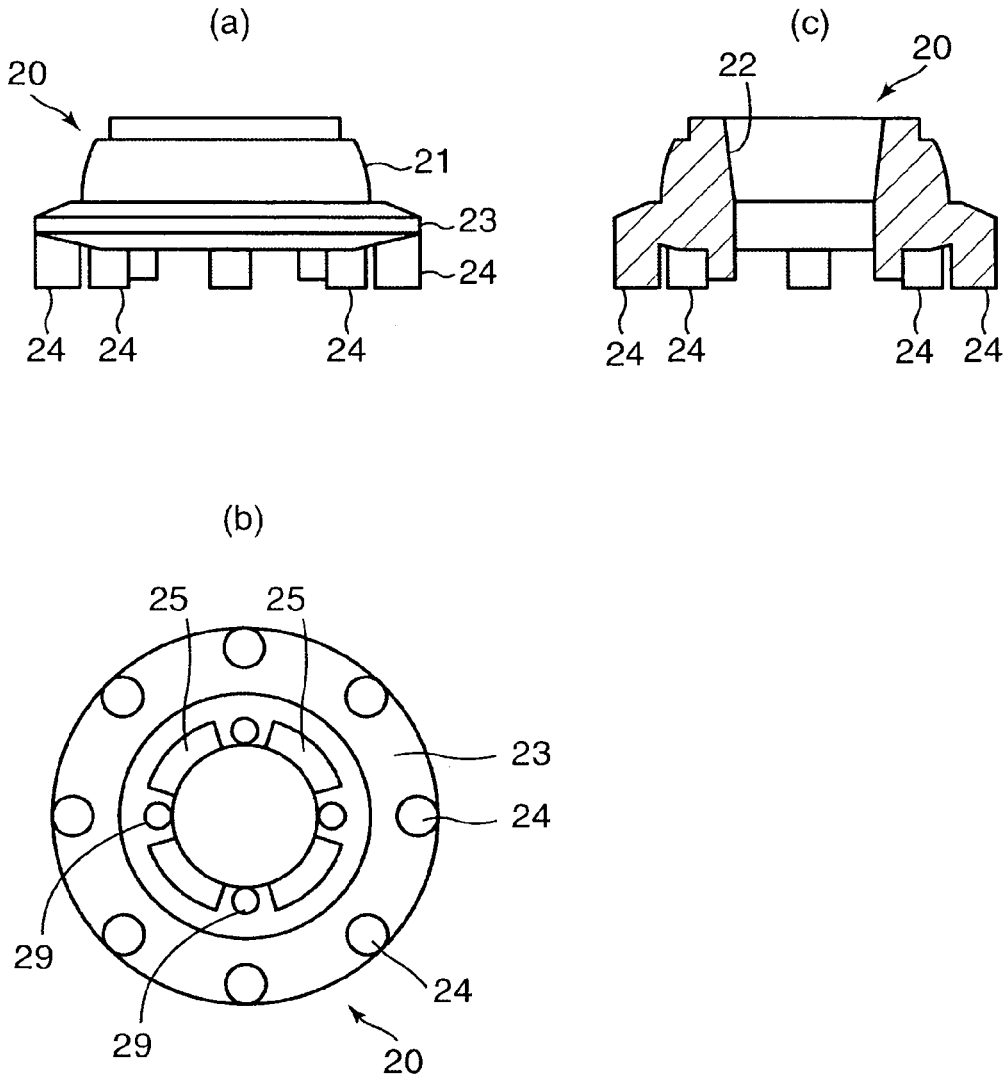
FIGS. 4 are views showing three sides of another component of the drive unit used in the multi-contact input device, in which (a) is an elevational view showing an inner member, (b) is a bottom view showing the inner member, (c) is a vertical sectional view showing the inner member.
Figure 5:
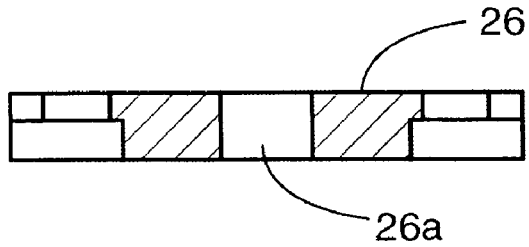
FIGS. 5 are views showing two sides of still another component of the drive unit used in the multi-contact input device, in which (a) is a vertical sectional view showing a bottom plate and (b) is a bottom view showing the bottom plate.
Figure 5:
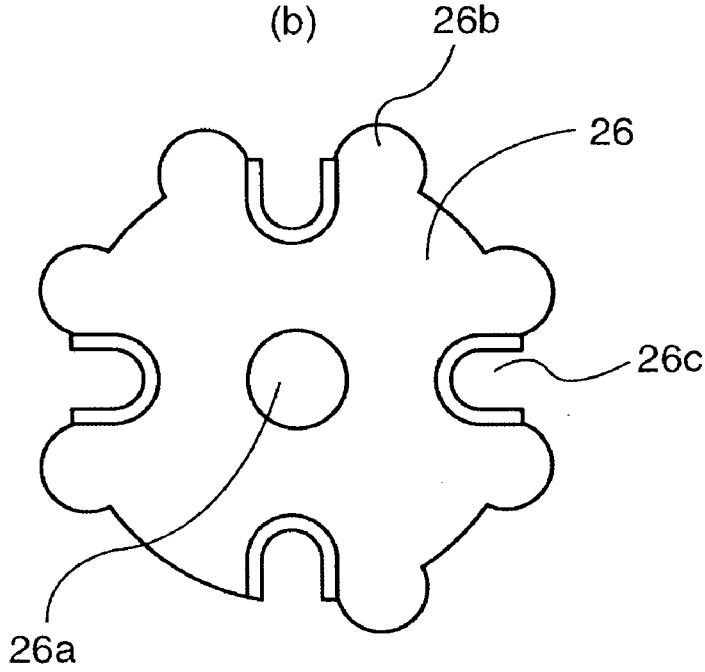
Figure 6:
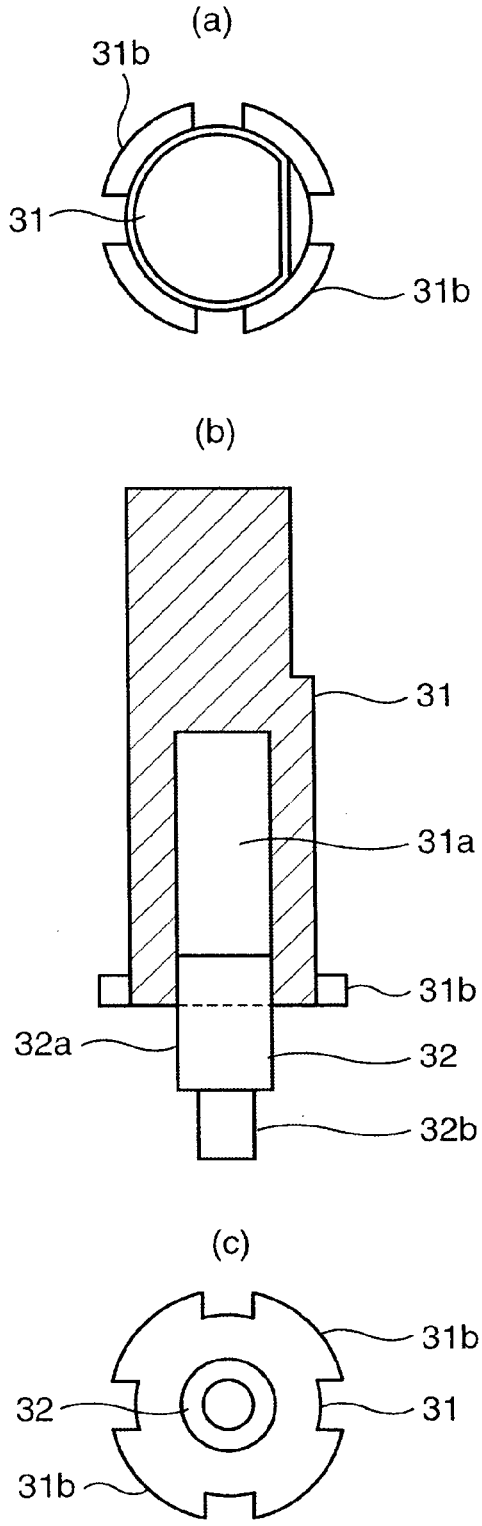
FIGS. 6 are views showing three sides of an operating member used in the multi-contact input device, in which (a) is a plan view, (b) is a vertical sectional view, and (c) is a bottom view.
Figure 7:
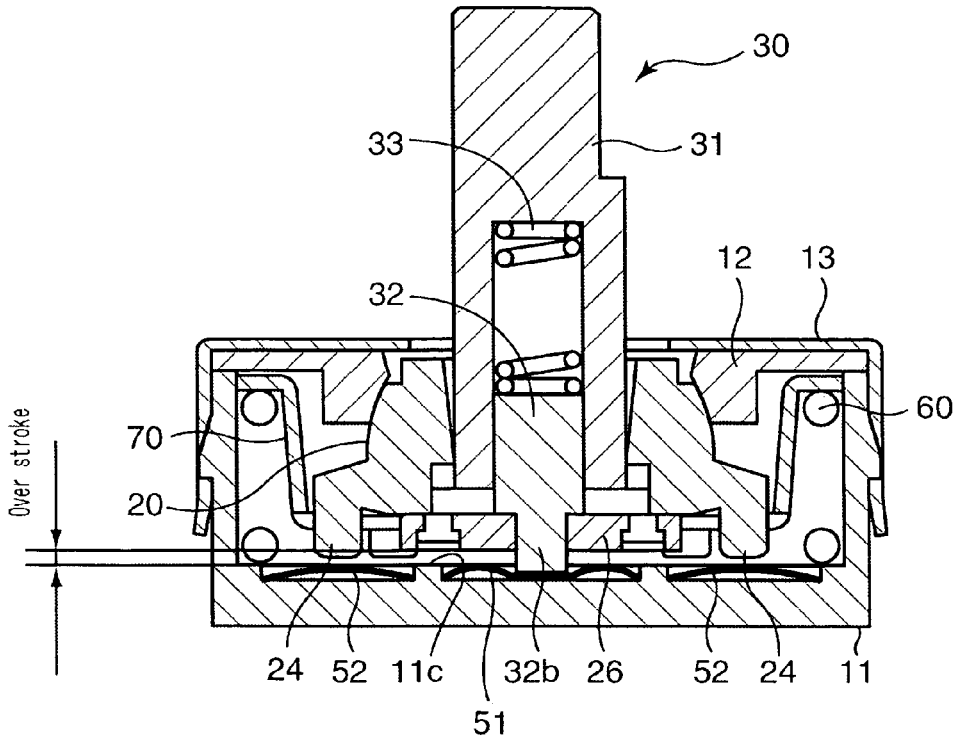
FIGS. 7(*a*) and (*b*) are vertical sectional views to explain an operation of the multi-contact input device.
Figure 7:
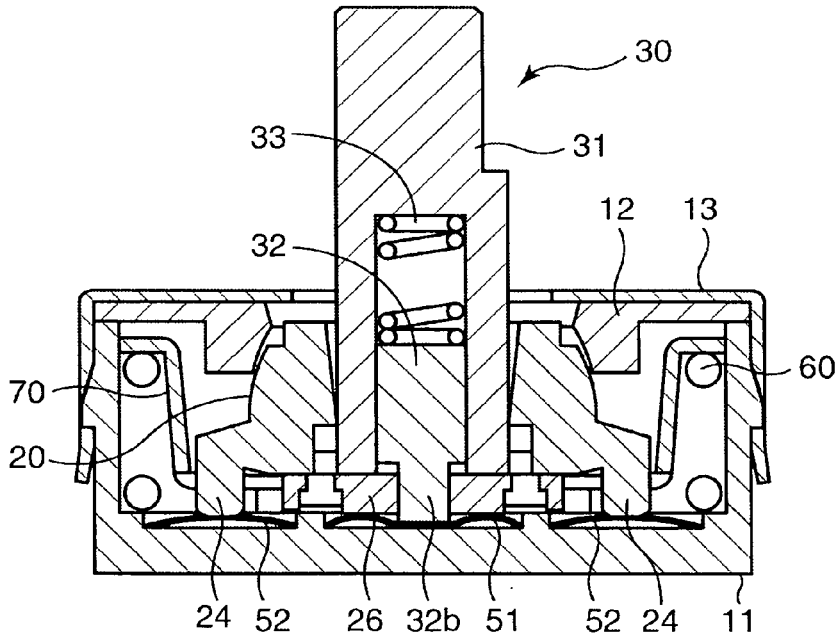
Figure 8:
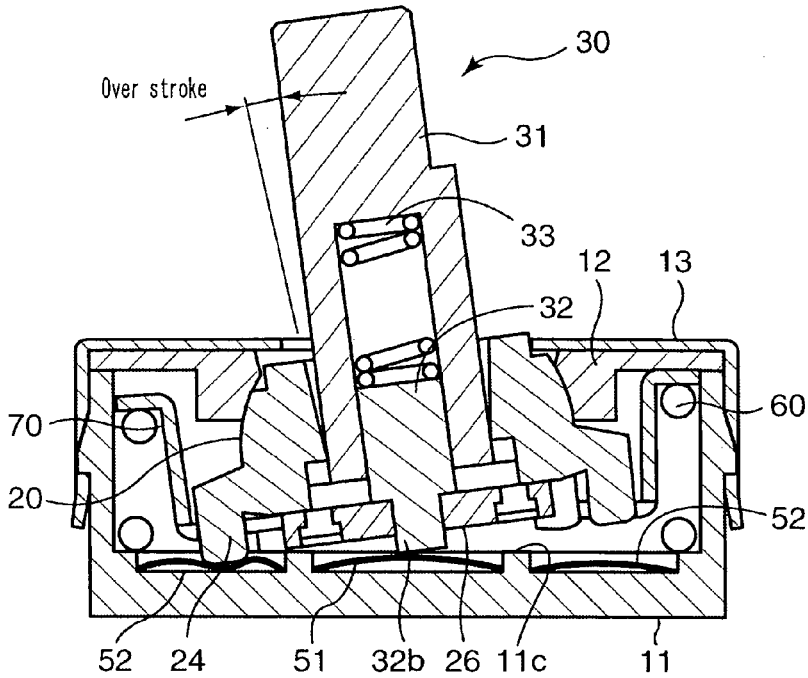
FIGS. 8(*a*) and (*b*) are vertical sectional views to explain another operation of the multi-contact input device.
Figure 8:
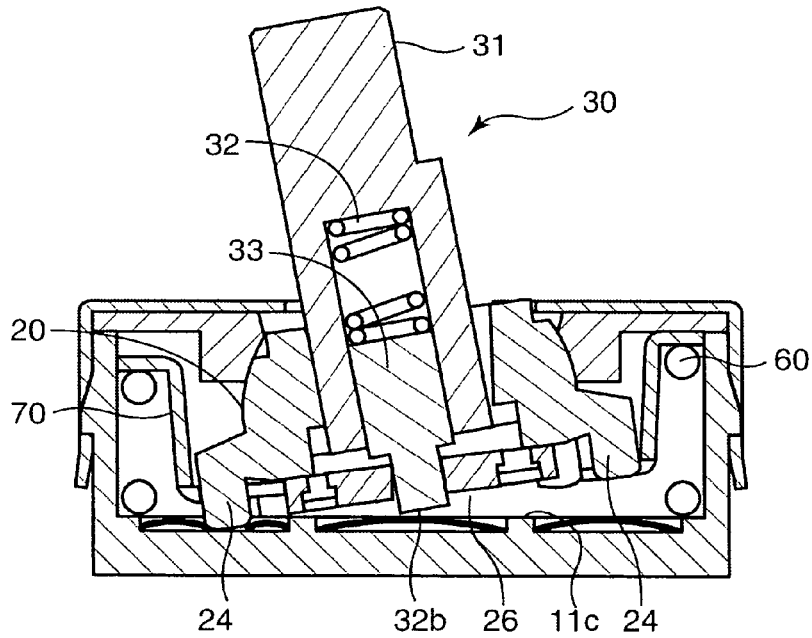

FIG. 1 is a vertical sectional view showing a multi-contact input device according to one embodiment of the present invention, FIG. 2 are views showing two sides of a body used in the multi-contact input device, FIG. 3 are views showing two sides of a component of a drive unit used in the multi-contact input device, FIG. 4 are views showing three sides of another component of the drive unit used in the multi-contact input device, FIG. 5 are views showing two sides of still another component of the drive unit used in the multi-contact input device, FIG. 6 are view showing three sides of an operating member used in the multi-contact input device, FIG. 7 is a vertical sectional view showing a pressing operation of the multi-contact input device, and FIG. 8 is a vertical sectional view showing an inclining operation of the multi-contact input device.

As shown in FIG. 1, a multi-contact input device according to this embodiment comprises a case 10 housing various kinds of components, an annular drive unit 20 supported so that it is inclinable in the direction of entire circumference in the case 10, and a stick-shaped operating member 30 penetrating in an axis direction in the case to operate the drive unit 20.

The case 10 consists of a box-shaped body 11 made of a resin, a lid 12 made of a resin to cover its upper opening, and a metal cover 13 mounted on the body 11 to cover the lid 12 to fix the lid 12 to the body 11.

As shown in FIG. 2, the body 11 made of the resin is almost an octagonal box in which its upper face is opened. A circular recessed part 11*a* is positioned in the center of an upper surface of a bottom plate and a plurality of circular recessed parts 11*b* (eight in this example) are provided so as to surround it. The plurality of recessed parts 11*b* are continued in the circumference direction and an annularly projected stopper 11*c* is formed between those parts and the central recessed part 11*a*.

A metal terminal 40 is insert-molded in the bottom plate of the body 11. A fixed contact 41 for a central switch is positioned in the center and a plurality of fixed contacts 42 (eight in this example) for peripheral switches are provided so as to surround this on a surface of the metal terminal 40. Thus, the fixed contact 41 for the central switch is positioned in the recessed part 11*a* and exposed to the surface side, and the plurality of fixed contacts 42 for the peripheral switches are positioned in the plurality of recessed parts 11*b* and exposed to the surface side. Reference numeral 43 designates a pulled-out lead of the metal terminal 40.

A snap plate 51 which is a diaphragm-shaped movable contact is provided over the fixed contact 41, and a plurality of snap plates 52 which are diaphragm-shaped movable contacts are provided over the plurality of fixed contacts 42. The snap plates 51 and 52 constitute the central switch and the peripheral switches in cooperation with the fixed contacts 41 and 42. That is, the snap plates 51 and 52 are housed in the corresponding recessed parts 11*a* and 11*b*, respectively and fixed in those recessed parts by a film applied from above to constitute the central switch and the peripheral switches.

The lid 12 made of the resin is almost an octagonal plate corresponding to a planar configuration of the body 11 and has a circular opening 12*a* in its center to protrude the operating member 30 above the case 10. A convex spherical press face 12*b* is provided on the peripheral surface of the opening 12*a* in order to support the drive unit 20 which will be described below from above so that it can be freely inclined.

The metal plate cover 13 has an octagonally-shaped top plate corresponding to the planar configuration of the body 11. A circular opening 13*a* is provided in the center of the top plate so as to project the operating member 30 above the case 10. The cover 13 also has a plurality of engagement parts projecting downward like tongues from outer edge of the top plate. When each engagement part engages with a click-shaped projection formed on the outer periphery of a side wall of the body 11, the cover 13 is mounted on the body 11 and the lid 12 is fixed to the body 11.

The drive unit 20 is housed in a cup-shaped retainer member 70 made of metal, in the case 10. As shown in FIG. 3, the cup-shaped retainer member 70 comprises a cup-shaped main body 71 in which an upper surface is open and an annular supporting part 72 extending from an opening edge of the main body 71 toward the outer periphery like a flange.

The main body 71 of the retainer member 70 has an elliptically-shaped opening 73 in the center in the bottom plate to project a part of the drive unit 20 downward as the operating part, and a plurality of openings 74 which surround it. The central opening 73 corresponds to the central switch and the peripheral openings 74 are provided to operate the plurality of peripheral switches. The supporting part 72 of the retainer member 70 is formed into almost an octagon corresponding to the planar configuration of the body 11 so as to fit in it. Thus, when the supporting part 72 is forced upward by a coil-shaped spring 60 housed in the body 11 along its side wall and serving as a center return spring after inclination.

As shown in FIG. 4, the drive unit 20 is the annular member made of the resin which is housed in the main body 71 of the cup-shaped retainer member 70 and has a through hole in the center. The drive unit 20 is forced upward by the above-described spring 60 together with the retainer member 70. There is a dome part 21 which is formed into the shape of a convex dome at an upper part of the drive unit 20, which is elastically pressed toward the spherical press face 12*b* formed on the periphery of the opening 12*a* of the lid 12 by the above forcing member.

A taper face 22 whose diameter is gradually increased upward is provided in an inner periphery of the dome part 21 in order to relatively incline the operating member 30 which will be described below, in a peripheral direction.

A key top 23 which is an annular disk is provided at a lower part of the drive unit 20. The key top 23 is the annular disk having a diameter greater than that of the dome part 21, and a plurality of round rod-shaped operating parts 24 are projected from its outer periphery of a lower surface. The plurality of operating parts 24 project downward from the plurality of openings 74 provided in the main body 71 of the retainer member 70 in order to operate the plurality of peripheral switches.

A plurality of arc-shaped recessions 25 (four in this example) are provided in the lower surface of the key top 23 so as to surround the through hole in the center. In addition, a projection 29 for welding is provided so as to be positioned between the adjacent recession 25. The plurality of the arc-shaped receptions 25 are continued to the inner through hole.

A fixing board 26 shown in FIG. 5 is mounted on the center of the lower surface of the key top 23 by welding in order to cover the through hole of the drive unit 20. The fixing board 26 also serves as a member for preventing the operating member 30 from a falling, and a circular through hole 26*a* is provided in the center thereof in order to project a part of the operating member 30 downward.

The fixing board 26 fits in the opening 73 provided in the center of the main body 71 of the retainer member 70 so that it cannot be rotated. Therefore, a plurality of semicircular projections 26*b* are provided on the outer periphery of the fixing board 26. In addition, a plurality of semicircular recessions 26*c* are provided in the outer periphery of the fixing board 26. The plurality of recessions 26*c* correspond to the plurality of projections 29 provided on the lower surface of the key top 23, and the fixing board 26 is welded to the center of the lower surface of the key top 23 using these projections 29.

As shown in FIG. 6, the operating member 30 comprises a shaft-shaped operating member main body 31 and a push rod 32 incorporated in this. The operating member main body 31 is inserted from beneath to the through hole provided in the center of the inner member 22 and its upper part penetrates the drive unit 20 and protrudes to an upper part of the case 10.

An insertion hole 31*a* to which the push rod 32 is slidably inserted is provided so as to be open downward in the center of the operating member main body 31. Meanwhile, a plurality of locking parts 31*b* (four in this example) which extend to the outer periphery side are provided at an outer periphery of a lower end of the operating member main body 31. The plurality of locking parts 31*b* are arc-shaped stoppers which are inserted into the plurality of recessions 25 provided in the lower surface of the drive unit 20 and prevent the operating member main body 31 from coming out upward and stop rotation of the drive unit 20 in the axis direction.

The push rod 32 comprises a large-diameter part 32*a* which is slidably inserted to the insertion hole 31*a* of the operating member main body 31, and a small-diameter operating part 32*b* protruding downward from the center of the lower surface of the large-diameter part 32*a*. The large-diameter part 32*a* is prevented from coming out by the above-describe fixing board 26 and the small-diameter operating part 32*b* protrudes downward from the through hole 26*a* of the fixing board 26 to operate the central switch. Thus, the push rod 32 is forced downward by the switch-protecting coil-shaped spring 33 which is inserted into the insertion hole 31*a* in a compressed state.

Then, a description will be made of a function of the multi-contact input device, especially a function based on a force relation of the spring 60 which is the center return spring and the spring 33 for protecting the switch.

The drive unit 20 housed in the case 10 is elastically retained in a neutral position by the spring 60 housed in the case 10 together with the drive unit 20. More specifically, as shown in FIG. 1, while the annular supporting part 72 of the retainer member 70 which houses the drive unit 20 is elastically pressed against the lid 12 of the case 10 by the spring 60, the drive unit 20 is elastically held in the neutral position.

Accordingly, the operation member 30 which penetrates the drive unit 20 is also elastically held in the vertical neutral position. That is, the spring 60 is a center return spring which elastically holds the operating member 30 in the neutral position and automatically brings it to the neutral position.

In this state, the plurality of operating parts 24 provided on the lower surface of the key top 23 of the drive unit 20 are separated from the snap plates 52 of the plurality of corresponding peripheral switches. In addition, the main body 31 of the operating member 30 is forced upward by the spring 33. By this force, the operating member main body 31 is held so as to be vertical to the drive unit 20, that is, in a concentric state. Meanwhile, the push rod 32 forced downward is separated from the snap plate 51 of the corresponding central switch or if it is not separated, it abuts on the snap plate 51 slightly.

An important thing here is that the elastic force of the spring 33 incorporated in the operating member 30 is stronger that that of the spring 60 forcing the drive unit 20.

That is, when the operating member 30 is pressed downward from the neutral state shown in FIG. 1, although the spring 60 shrinks and moves the drive unit 20 downward, the spring 33 in the operating member 30 does not shrink. In addition, when the operating member 30 is inclined from the neutral position to the periphery, the spring 60 is deformed according to the operation and inclines the drive unit 20 but the spring 33 in the operating member 30 does not shrink. As a result, the operating member 30 holds the neutral position, that is, the vertical state with respect to the drive unit 20.

In the state in which the elastic forces of the springs 60 and 33 are set as described above, when the operating member 30 is pressed downward, because only the spring 60 is compressed and deformed as shown in FIG. 7(*a*), the drive unit 20 and the retainer member 70 are lowered together with the operating member 30 and the snap plate 51 of the central switch is pressed by the push rod 32 of the operating member 30. Thus, the snap plate 51 is elastically deformed in a normal manner, so that the central switch is switched from an off state to an on state.

At this time, the plurality of operating parts 24 provided on the lower surface of the drive unit 20 are separated from the snap plate 52 of the corresponding plurality of peripheral switches. In addition, the fixing board 26 welded to the drive unit 20 is separated from the annular stopper 11*c* provided on the upper surface of the bottom plate of the body 11.

When a strong pressing force in the axial direction is further applied to the operating member 30 because of a dropping and the like, although the operating member main body 31 is pressed in the drive unit 20 against the force by the spring 33 in the operating member 30, because the pressing force is absorbed by compression of the spring 33, the force applied to the central switch does not exceed the force generated by the spring 33. Therefore, if the force generated by the spring 33 is set at a degree in which plastic deformation (damage) of the snap plate 51 of the central switch does not occur, the central switch can be prevented from being damaged. In addition, an over stroke when the operating member 30 is pressed in the axis direction can be ensured.

When the operating member 30 is further pressed, as shown in FIG. 7(*b*), although the operating member main body 31 is lowered and abuts on the fixing board 26 of the drive unit 20 to lower the drive unit 20 and the retainer member 70, because the outer periphery of the fixing board 26 abuts on the annular stopper 11*c* provided on the upper surface of the bottom plate of the body 11, the operating member 30 is not further lowered. Because of the over stroke of the drive unit 20, the central switch can be surely protected.

Even in this state, the plurality of operating parts 24 provided on the lower surface of the drive unit 20 do not press the snap plates 52 of the corresponding plurality of peripheral switches. Therefore, the plurality of peripheral switches are also protected.

When the operating member 30 is operated to be inclined, as shown in FIG. 8(*a*), because the operating member 30 maintains a vertical state with respect to the drive unit 20, the drive unit 20 is inclined with the retainer member 70 according to the inclined operation of the operating member 30.

At this time, as the operating part 24 provided on the lower surface of the drive unit 20 abuts on the snap plate 52 of the corresponding peripheral switch and elastically deforms it, the peripheral switch is switched from the off state to the on state, so that the inclined direction of the operating member 30 can be detected.

When the operating member 30 is further inclined, as shown in FIG. 8(*b*), the operating member 30 is inclined with respect to the drive unit 20 against the force by the spring 33 in the operating member 30.

The inclination of the operating member 30 at this time becomes the over stroke and a sense of operation is further improved. Because the spring 33 for protecting the central switch is used in this inclination, a spring for the over stroke in the inclined direction is not needed.

At this time also, the force applied to the peripheral switch does not exceed the force by the spring 33. Therefore, the peripheral switch can be effectively prevented from being damaged.

Figure 9:
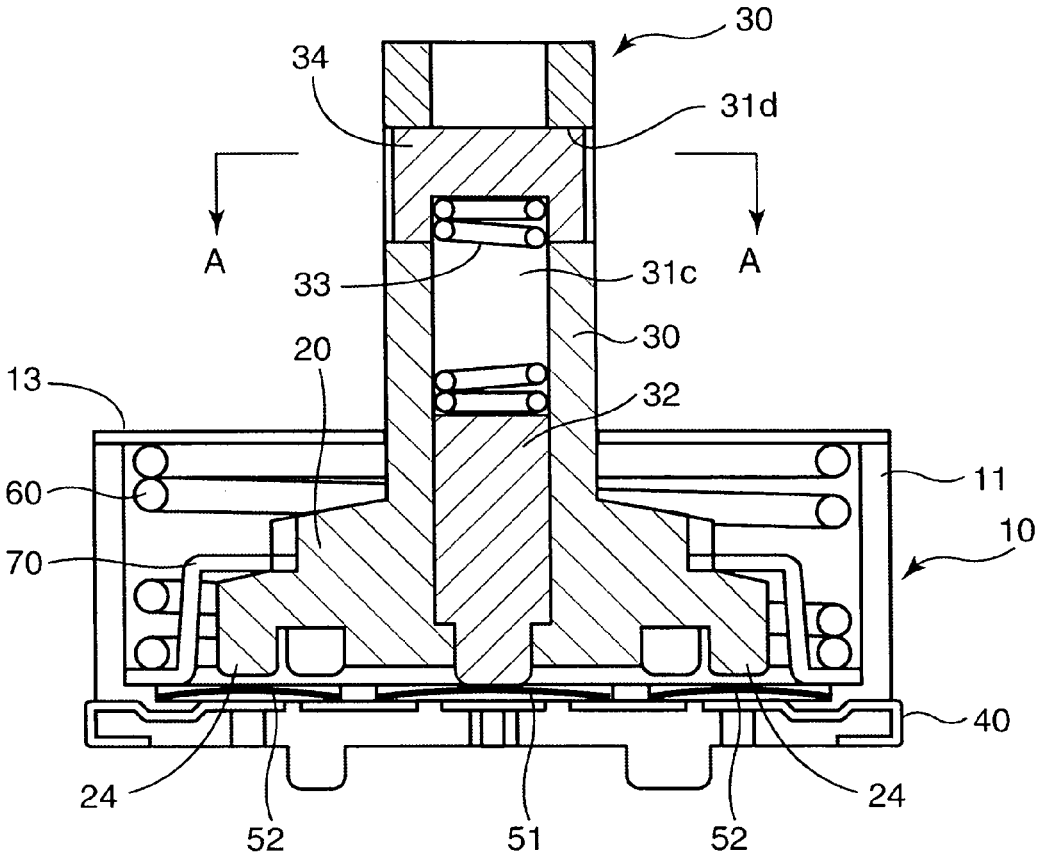
FIG. 9 is a vertical sectional view showing a multi-contact input device according to another embodiment of the present invention.
Figure 10:
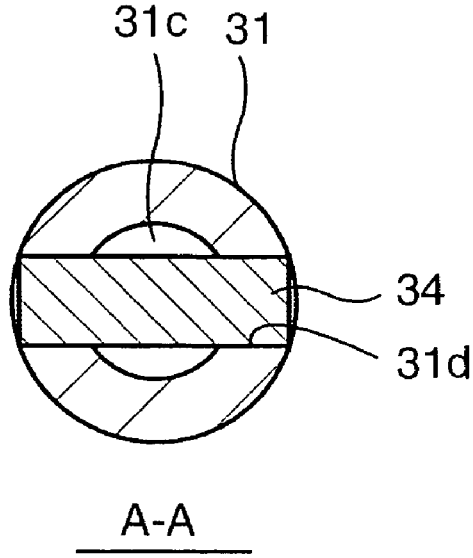
FIGS. 10 is a view taken in the direction of arrow A—A of FIG. 9.
Figure 11:
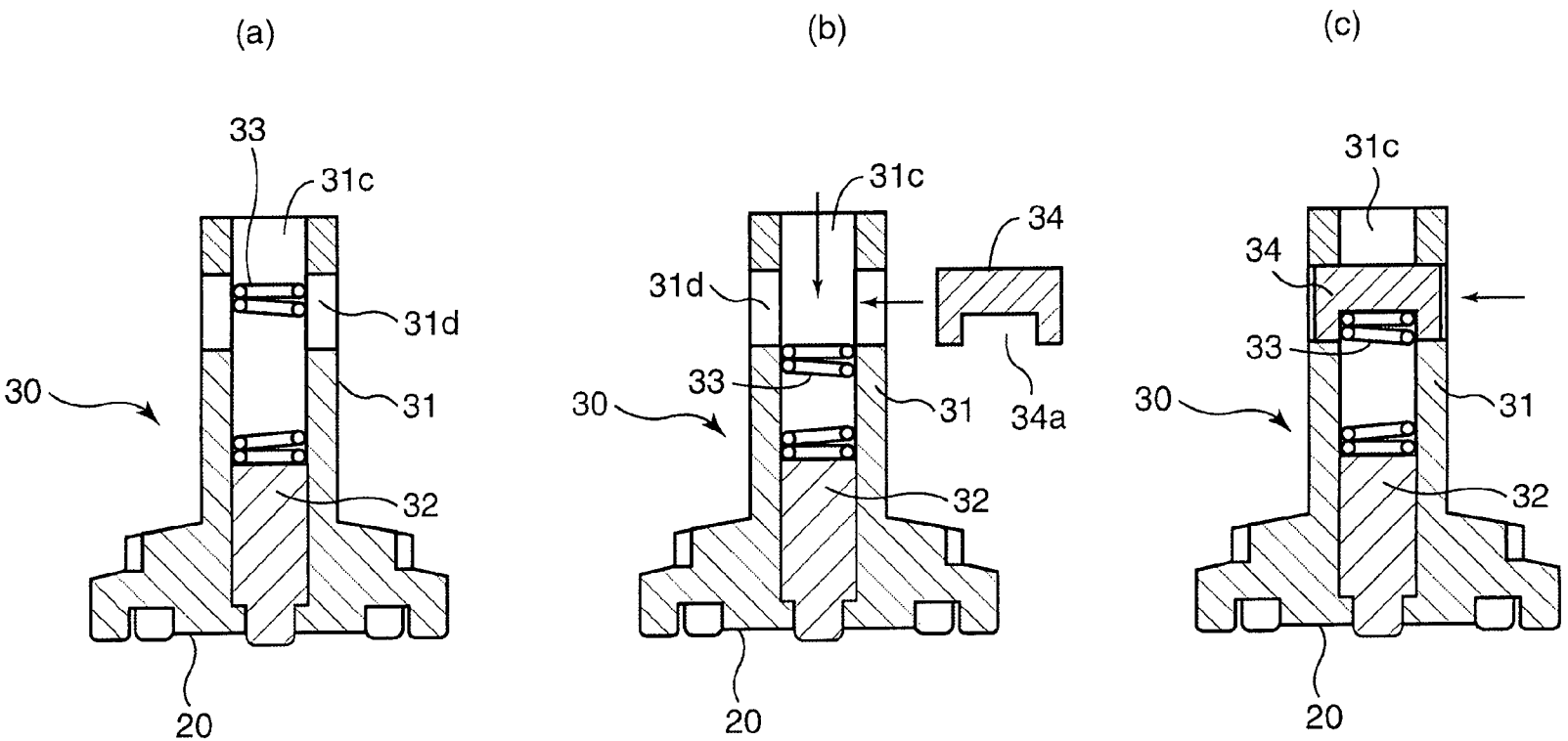
FIGS. 11(*a*) to (*c*) are vertical sectional views showing a structure of an operating member which is a main part of the multi-contact input device in the order of assembly.
Figure 12:
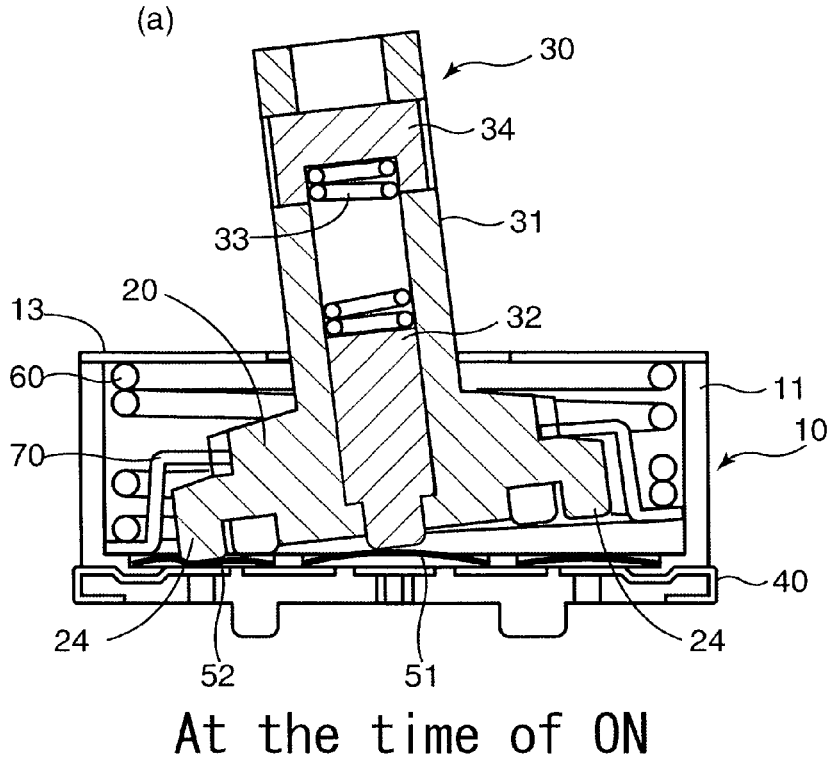
FIGS. 12(*a*) and (*b*) are vertical sectional views to explain an operation of the multi-contact input device.

FIG. 9 is a vertical sectional view showing a multi-contact input device according to another embodiment of the present invention, FIG. 10 is a view taken in the direction of arrows A—A of FIG. 9, FIG. 11 are vertical sectional views showing an operating member which is a main part of the multi-contact input device in the order of assembly, and FIGS. 12(*a*) and (*b*) are vertical sectional views showing an operation of the multi-contact input device.

The multi-contact input device according to this embodiment is largely different from the above-described multi-contact input device shown in FIGS. 1 to 8 in structures of an operating member 30, a drive unit 20 and its retainer member 70. First, the operating member 30 will be described in detail.

According to the above-described multi-contact input device, because the spring 33 forcing the push rod 32 of the operating member 30 is enclosed in the operating member 30, the insertion hole 31*a* which is opened downward is provided in the main body 31 of the operating member 30 and after the spring 33 and the push rod 32 are inserted into this from beneath, the insertion hole 31*a* is sealed by the bottom plate 26 mounted on the lower surface of the drive unit 20. The bottom plate 26 of the drive unit 20 also serves as the stopper which holds the operating member 30 inside the drive unit 20 and holds the push rod 32 in the operating member main body 31.

Meanwhile, according to the multi-contact input device in this embodiment, as shown in FIGS. 9 to 11, because a push rod 32 and a spring 33 are housed in a main body 31 of the operating member 30, a housing hole 31*c* penetrating the center part of the operating member main body 31 in the axial direction is provided. According to the penetrating type of housing hole 31*c*, a diameter at a lower end is decreased in order to prevent the push rod 32 from falling down and an entire surface is opened upward in order to introduce the push rod 32 and the spring 33. Thus, in order to hold the push rod 32 and the spring 33 inserted from the above in the insertion hole 31*c*, a plug body 34 which penetrates the operating member main body 31 at right angles is used.

That is, an insertion hole 31*d* having a square section is provided in the operating member main body 31 so that the section intersects with the housing hole 31*c* having a circular section at right angles. The push rod 32 and the spring 33 are inserted to the housing hole 31*c* of the operating member main body 31 from above and the plug body 34 is inserted to the insertion hole 31*d* from the side of the operating member main body 31 in a state the spring 33 is compressed in the inserting direction (downward), so that the push rod 32 and the spring 33 are enclosed in the operating member main body 31. For this enclosure, the insertion hole 31*d* is provided so as to be positioned on the compressed spring 33.

Thus, according to the multi-contact input device in this embodiment also, the push rod 32 and the spring 33 are enclosed in the main body 31 of the operating member 30 and the push rod 32 is forced downward. In addition, because the plug body 34 is pressed upward in the insertion hole 31*d*, the plug body 34 is prevented from coming out. In order to surely prevent the coming out, a recession 34*a* in which an upper part of the spring 33 fits is provided on a lower surface of the plug body 34. As compared with the above-described multi-contact input device shown in FIGS. 1 to 8, it is not necessary to weld the fixing board 26, so that the enclosing operation is simple.

The drive unit 20 made of a resin is integrated with the main body 31 of the operating member 30 formed of the resin also. A disk-shaped key top 23 is provided at a lower part of the drive unit 20 and a plurality of convex operating parts 24 corresponding to a plurality of peripheral switches are provided in an outer periphery of its lower surface. In addition, a metal retainer member 70 which retains the drive unit 20 is formed into an inversed cap which fits the drive unit 20 from above, and a spring 60 which elastically holds the drive unit 20 in a neutral position is housed between a flange-shaped supporting part 42 of the cup-shaped retainer member 70 and a cover 13 which is a top plate of a case 10, in a compressed state to force the retainer member 70 downward.

Its other arrangements are the same as multi-contact input device shown in FIGS. 1 to 8.

According to the multi-contact input device in this embodiment, the drive unit 20 and the operating member 30 in the retainer member 70 are forced downward by the spring 60 together with the retainer member 70 and elastically held in the neutral position. The force generated by the spring 33 in the operating member 30 is greater than a restoring force of a snap plate 51 in the central switch. Therefore, when the operating member 30 is pressed downward by force stronger than the restoring force of the snap plate 51 in the central switch, the central switch is operated.

Here, when it is set such that the force generated by the spring 33 in the operating member 30 is greater than the restoring force of the central switch and plastic deformation (damage) of its snap plate 51 does not occur, the central switch is prevented from being damaged in the case of dropping, for example like the case of the above-described multi-contact input device shown in FIGS. 1 to 9.

Meanwhile, if the operating member 30 is operated to be inclined by a force greater than the retention force generated by the spring 60, the peripheral switch can be operated. According to the operation of the peripheral switch, as shown in FIG. 12(*a*), the drive unit 20 is inclined to the periphery centering around the bottom surface of the push rod 32 first, and the peripheral switch positioned in the operated direction is pressed and operated by the operating part 24 of the drive unit 20. At this time, the drive unit 20 is inclined in the retainer member 70 and the retainer member 70 is also inclined.

When the operating member 30 is further inclined from this state, as shown in FIG. 12(*b*), the drive unit 20 and the operating member 30 are turned centering around the bottom surface of the operating part 24 in a state such that the bottom surface of the push rod 32 is separated from the central switch. At this time, the retainer member 70 is mainly inclined. Thus, because a sufficient over stroke is provided when the operating member 30 is operated to be inclined in this embodiment also, the operation can be improved. In addition, because the spring 60 shrinks when the retainer member 70 is inclined, an outer force greater than a force which makes the spring 60 shrink is not applied to the peripheral switch, so that the peripheral switch can be protected.

Figure 13:
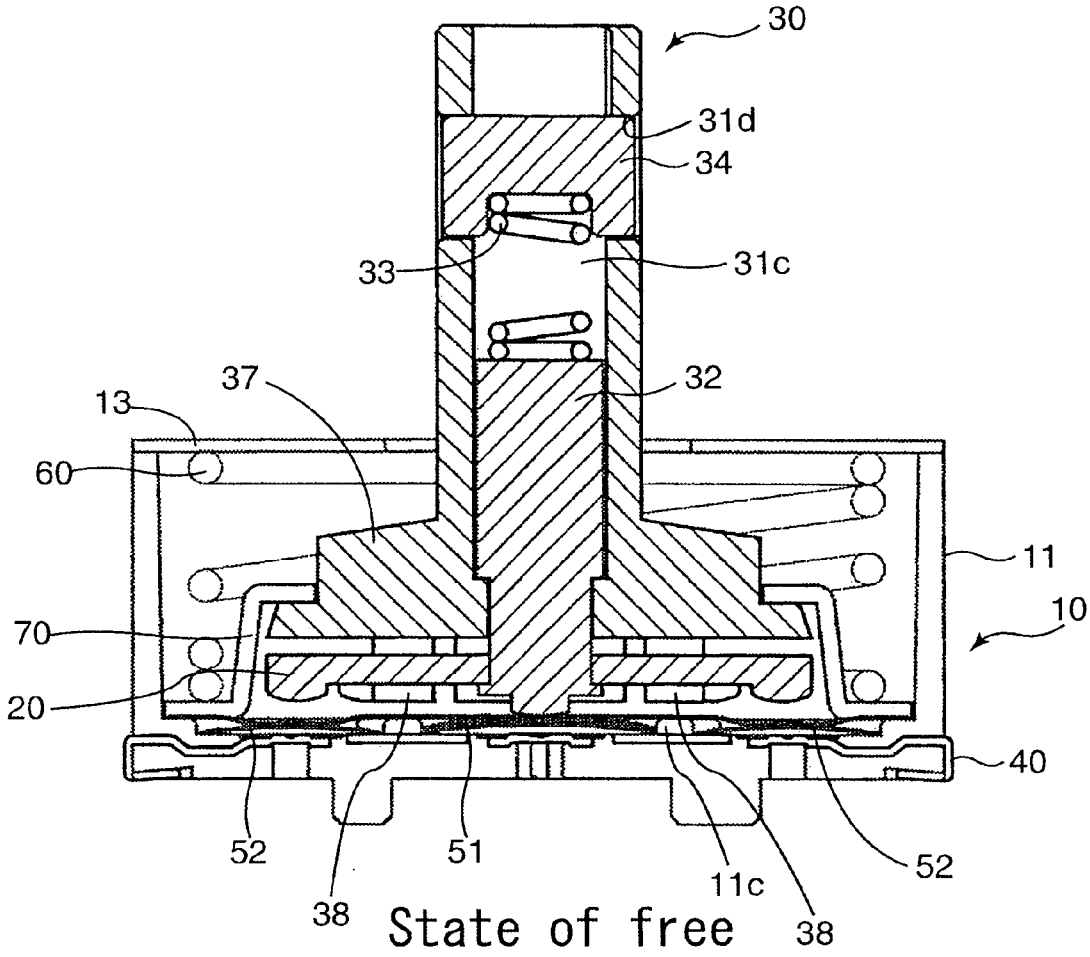
FIG. 13 is a vertical sectional view showing a multi-contact input device according to still another embodiment of the present invention.
Figure 14:
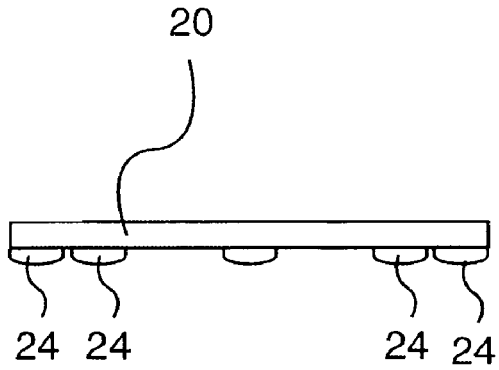
FIG. 14 are views showing two sides of a drive unit used in the multi-contact input device,. in which (a) is an elevational view and (b) is a bottom view.
Figure 14:
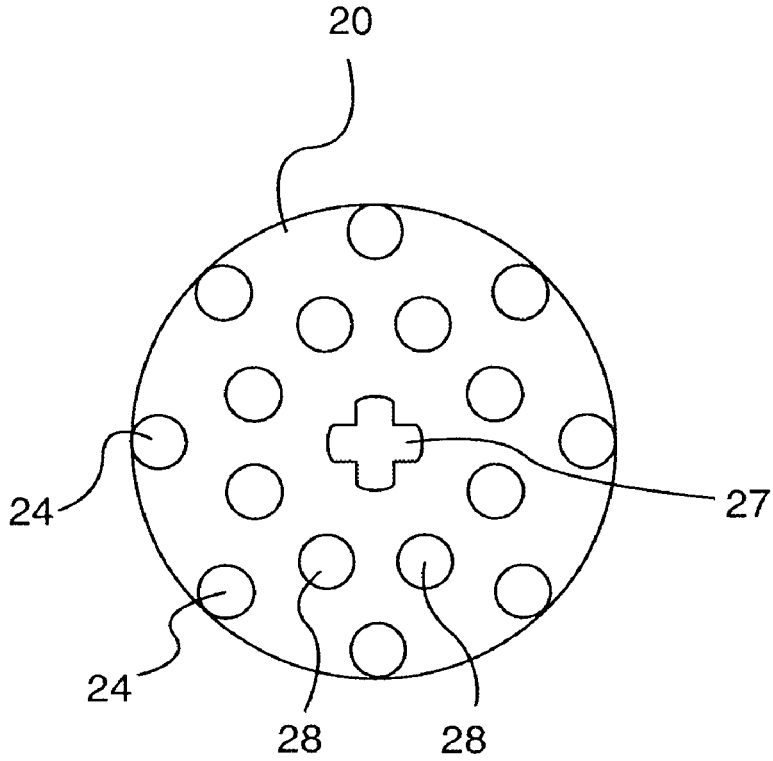
Figure 15:
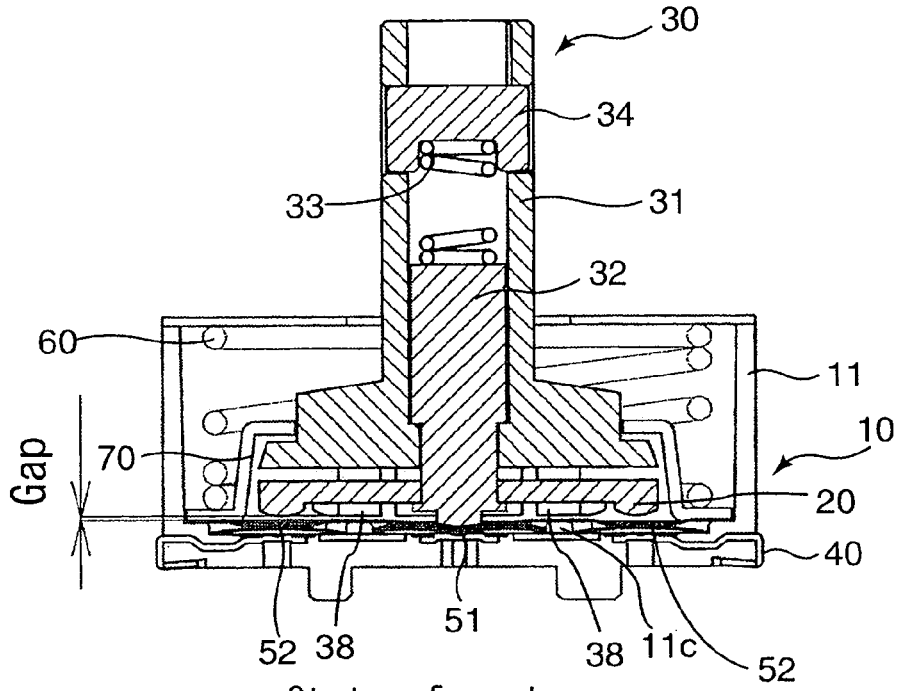
FIGS. 15(*a*) and (*b*) are vertical sectional views showing an operation of the multi-contact input device.
Figure 15:
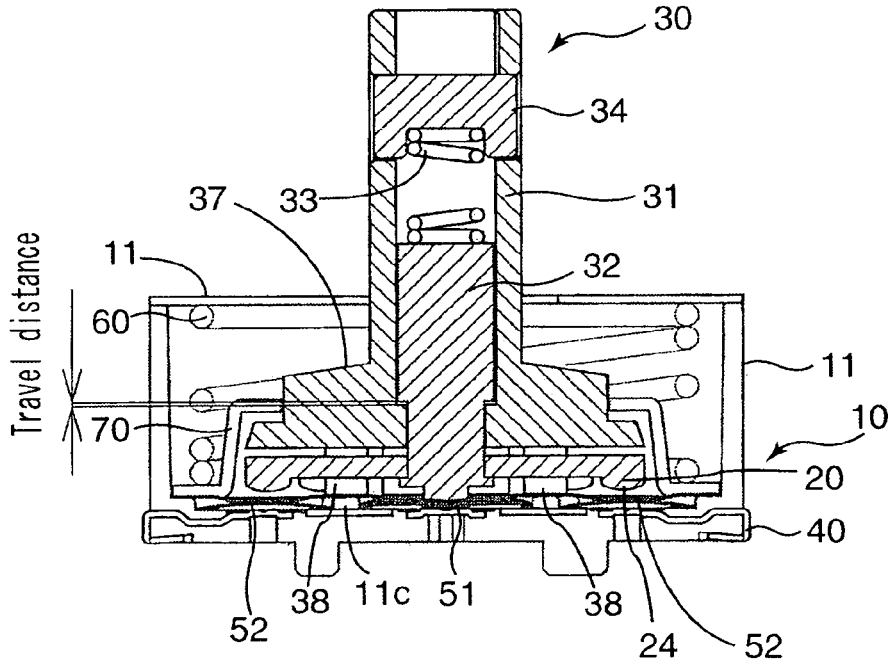
Figure 16:
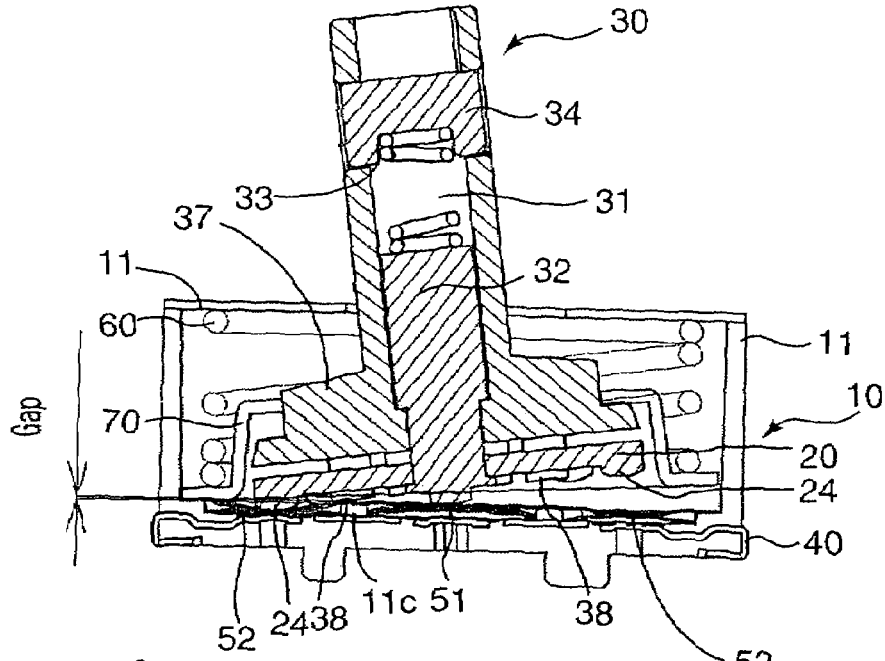
FIGS. 16(*a*) and (*b*) are vertical sectional views showing another operation of the multi-contact input device.
Figure 16:
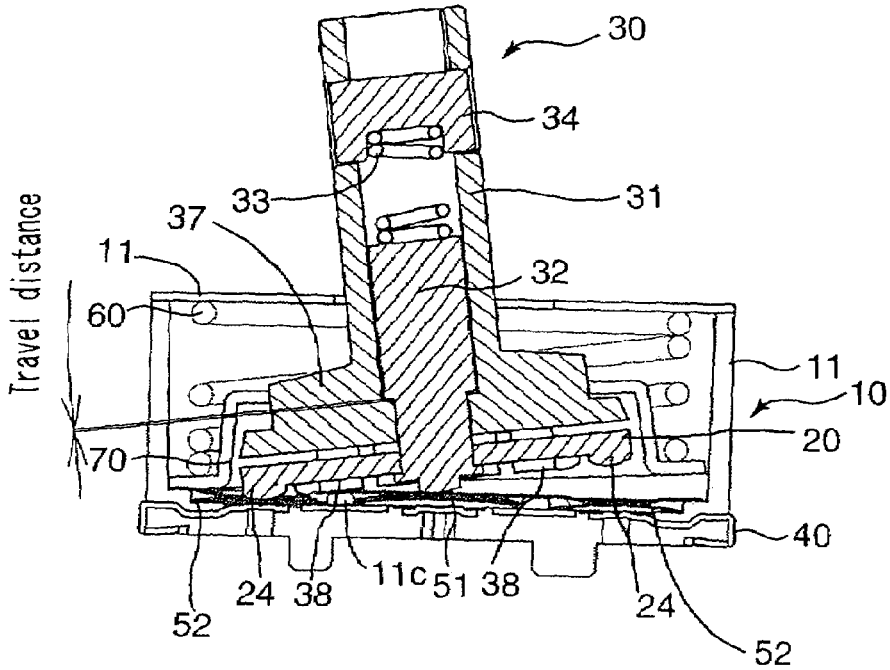

FIG. 13 is a vertical sectional view showing a multi-contact input device according to still another embodiment of the present invention, FIGS. 14(*a*) and (*b*) are views showing two sides of a drive unit used in the above multi-contact input device, FIGS. 15(*a*) and (*b*) are vertical sectional views showing an operation of that multi-contact input device, and FIGS. 16(*a*) and (*b*) are vertical sectional views showing another operation of that multi-contact input device.

The multi-contact input device according to this embodiment is different from the above-described multi-contact input device shown in FIGS. 9 to 12 in a structure of a drive unit 20. According to the above multi-contact input device, the drive unit 20 comprises a convex dome part 21 at an upper part and the annular disk-shaped key top 23 continued from the upper part at a lower part, which are integrated with the main body 31 of the operating member 30. Meanwhile, according to the multi-contact input device in this embodiment, the drive unit 20 is an annular disk corresponding to the above-described key top 23 and bonded to a projection end which protrudes from a push rod 32 of an operating member 30, more specifically from an operating member main body 31 of the push rod 32 by welding.

A dome part corresponding to a dome part 21 of the drive unit 20 is integrated with the main body 31 of the operating member 30 as a retaining part 37 which fits in a retainer member 70. A plurality of round rod-shaped projections 38 are provided on a lower surface of the retaining part 37 as stoppers of the pressing operation.

The disk-shaped drive unit 20 arranged on the lower side of the retaining part 37 is bonded to a projection end of the push rod 32 of the operating member 30 so as to be slightly spaced from the upper retaining part 37. As shown in FIGS. 14(*a*) and (*b*), a first through hole 27 to which a tip end of the push rod 32 is inserted is provided in the center and a plurality of second through holes 28 to which the plurality of round rod-shaped projections 38 provided on the lower surface of the retaining part 37 are inserted are provided so as to surround the first through hole 27 in the drive unit 20. In addition, a plurality of convex operating parts 24 corresponding to a plurality of peripheral switches are provided on the outer periphery of the lower surface of the drive unit 20 so as to be spaced at the same intervals in the peripheral direction. The tip end of the push rod 32 and the first through hole 27 to which it is inserted are formed into a cross shape to position the drive unit 20 in the circumferential direction.

A body 11 made of a resin which forms a case 10 has an annular convex stopper 11*c* on an upper surface of the bottom plate so as to correspond to the plurality of projections 38. Its other formations are essentially the same as those of the multi-contact input device shown in FIGS. 9 to 12.

According to the multi-contact input device in this embodiment, the operating member 30 in the retainer member 70 is forced downward together with the retainer member 70 by a spring 60 and it is elastically retained in a neutral position. The push rod 32 in the operating member 30 is forced downward together with the drive unit 20 by a spring 33 in a state it is slightly in contact with a snap plate 51 of a central switch. This force is greater than a restoring force of the snap plate 51 of the central switch. Therefore, when the operating member 30 is pressed downward by force stronger than the restoring force of the snap plate 51, the central switch is operated by the tip end of the push rod 32 as shown in FIG. 15(*a*).

At this time, a gap is provided between an annular stopper 11*c* provided in the body 11 of the case 10 and the plurality of projections 38 provided on a lower surface of the operating member 30. In addition, the force generated by the spring 33 in the operating member 30 is set such that it is greater than a restoring force of the central switch, and plastic deformation (damage) of the snap plate 51 does not occur. Therefore, when the operating member 30 is further pressed downward, as shown in FIG. 15(*b*), the main body 31 of the operating member 30 is pressed downward until the plurality of projections 38 come in contact with the stopper 11*c*, but the push rod 32 is retreated into the operating member main body 31. Thus, the outer force applied to the central switch is the force by the spring 33 at most. Therefore, like the case of the above-described multi-contact input device, the central switch is prevented from being damaged if the operating member 30 receives excessive outer force in the axial direction. In addition, the over stroke in the pressing direction can be ensured.

Meanwhile, if the operating member 30 is operated to be inclined by force stronger the retention force by the spring 60, the peripheral switch can be operated. In this operation, as shown in FIG. 16(*a*), the drive unit 20 mounted on the push rod 32 is inclined to the periphery, centering around the bottom surface of the push rod 32, and the peripheral switch positioned in the inclined direction is pressed by the operating part 24. At this time, when the drive unit 20 is inclined with the operating member 30 in the retainer member 70, the retainer member 70 is also inclined at the same time. As they are further inclined, the operating member 30 is inclined using the operating part 24 as a supporting point, and the retainer member 70 is inclined using a part which is in contact with the bottom plate of the body 11 as a supporting point. Thus, an over stroke is provided by the above operation.

When the operating member 30 is further inclined from this state, as shown in FIG. 16(*b*), a reaction force from the peripheral switch is transferred to the push rod 32 of the operating member 30 through the drive unit 20 and the push rod 32 retreats in the operating member main body 31 against the force by the spring 33, so that the drive unit 20 is relatively moved in a retreating direction. The over stroke is increased in the inclining direction by the relative movement of the push rod 32 and a sense of operation can be improved.

Thus, according to the multi-contact input device in this embodiment, the central switch and peripheral switch can be prevented from being damaged while the large over stroke is provided like the multi-contact input device according to other embodiments.

In addition, according to the multi-contact input device in this embodiment, a plurality of projections can be provided in the vicinity of the center of a fixed contact 42 of the peripheral switch, and a plurality of projections can be provided in the vicinity of a top of the snap plate 51 of the central switch. Thus, stability of the contact is improved. In addition, the plurality of projections can be provided in the vicinity of the top of the snap plate 52 of the peripheral switch and the plurality of projections can be provided in the vicinity of the center of the fixed contact 41 of the central switch. To provide the projections in both fixed contact and snap plate in the central switch and the peripheral switch is not preferable because the projections interfere with each other.

What is claimed is:

1. A multi-contact input device comprising:

a cover;

a body in which the cover is mounted;

a central switch provided on a bottom plate of the body;

a plurality of peripheral switches provided around said central switch;

a drive unit provided so as to be inclinable to the periphery in a space between the cover and the body to operate the plurality of peripheral switches; and an operating member which penetrates the drive unit in an axial direction and is elastically held in a neutral position, and inclines the drive unit when inclined to the periphery against the holding force or operates said central switch by a pressing operation thereof in the axial direction, wherein the operating member has a push rod which projects from a main body of the operating member to a pressing side and is movable in the axial direction with respect to the main body of the operating member to operate the central switch, and a spring which is incorporated in the main body of the operating member with the push rod forces the push rod toward a pressing side with a force which is greater than a force required to operate the central switch and does not damage the central switch.

2. The multi-contact input device according to claim 1, wherein the drive unit is separated from the operating member.

3. The multi-contact input device according to claim 2, wherein the operating member and the drive unit are arranged so that the operating member is inclinable to a periphery with respect to the drive unit, and an elastic body which elastically holds the operating member in a neutral position with respect to the drive unit is provided.

4. The multi-contact input device according to claim 3, wherein said elastic body is arranged such that the operating member is not inclined with respect to the drive unit when the operating member is operated to incline the drive unit, and the operating member is inclined with respect to the drive unit when the operating member is operated with a force greater than a force which inclines the drive unit.

5. The multi-contact input device according to claim 3, wherein said elastic body is a spring which forces the push rod toward the pressing side.

6. The multi-contact input device according to claim 1, wherein the drive unit is integrated with said main body of the operating member.

7. The multi-contact input device according to claim 1, wherein the drive unit is integrated with the push rod of the operating member.

8. The multi-contact input device according to claim 1, wherein a bottom plate of the body or the drive unit, or the bottom plate of the body and the drive unit are provided with a stopper for restricting the drive unit or the operating member to be pressed in in movement toward the pressing side.

9. A multi-contact input device comprising:

a case;

a central switch provided on a bottom plate of said case;

a plurality of peripheral switches provided around said central swich;

a drive unit provided so as to be inclinable to the periphery in the case to operate the plurality of peripheral switches and to be held in a neutral position by an elastic body; and an operating member which penetrates the drive unit in an axial direction so as to be movable and which inclines the drive unit by its inclining operation and operates the central switch by its pressing operation in the axial direction, wherein in order to operate the central switch, the push rod is arranged so as to project from a main body of the operating member to the pressing side and is movable with respect to the main body of the operating member in the axial direction, and the push rod is forced to the projection side by a spring incorporated in the main body with the push rod with a force which is greater than a force required to operate the central switch and which does not damage the central switch.

10. The multi-contact input device according to claim 9, wherein the operating member and the drive unit are arranged such that the operating member is inclinable to the periphery with respect to the drive unit, the operating member is elastically held in a neutral position with respect to the drive unit using a force generated by the spring, and the operating member is not inclined with respect to the drive unit when the operating member is operated to incline the drive unit, and the operating member is inclined with respect to the drive unit when the operating member is operated with a force beyond a force which inclines the drive unit.

11. The multi-contact input device according to claim 9, wherein said main body of the operating member is forced by the spring from the drive unit to a direction opposite the pressing direction, and the push rod is incorporated in the drive unit so as to be forced from the drive unit to the pressing direction, and said elastic body which holds the drive unit in a neutral position also serves as an elastic body which forces the operating member in the direction opposite the pressing direction.

12. The multi-contact input device according to claim 11, wherein the case has a stopper on a bottom plate which prevents the drive unit from being lowered.

* * * * *